United States Patent [19]

Egashira et al.

[11] Patent Number: 4,990,485

[45] Date of Patent: Feb. 5, 1991

[54] HEAT TRANSFER IMAGE-RECEIVING SHEET

[75] Inventors: Noritaka Egashira; Yoshinori Nakamura; Kenichiro Suto; Masaki Kutsukake, all of Tokyo, Japan

[73] Assignee: Dai Nippon Insatsu Kabushiki Kaisha, Japan

[21] Appl. No.: 434,991

[22] Filed: Nov. 13, 1989

[30] Foreign Application Priority Data

| | | | |
|---|---|---|---|
| Nov. 10, 1988 | [JP] | Japan | 63-282589 |
| Jun. 21, 1989 | [JP] | Japan | 1-158748 |
| Jun. 21, 1989 | [JP] | Japan | 1-158749 |
| Sep. 14, 1989 | [JP] | Japan | 1-237239 |

[51] Int. Cl.[5] ..... B41M 5/035; B41M 5/26

[52] U.S. Cl. ..... 503/227; 8/411; 428/195; 428/421; 428/422; 428/423.1; 428/447; 428/474.4; 428/480; 428/500; 428/913; 428/914

[58] Field of Search ..... 8/471; 428/195, 913, 428/914, 421, 422, 423.1, 447, 474.4, 480, 500; 503/227

[56] References Cited

FOREIGN PATENT DOCUMENTS 1199997 9/1986 Japan ..... 503/227

*Primary Examiner*—Bruce H. Hess

*Attorney, Agent, or Firm*—Parkhurst, Wendel & Rossi

[57] ABSTRACT

A heat transfer image-receiving sheet having a dye receiving layer provided on the surface of a substrate sheet, said dye receiving layer comprising a graft copolymer having at least one releasing segment selected from the group consisting of polysiloxane segments, fluorinated carbon segments and long chain alkyl segments graft bonded to the main chain in the graft copolymer.

12 Claims, 1 Drawing Sheet

HEAT TRANSFER IMAGE-RECEIVING SHEET

BACKGROUND OF THE INVENTION

This invention relates to a heat transfer image-receiving sheet useful in a heat transfer method by use of a sublimable dye (heat migratable dye). More particularly, the invention is intended to provide a heat transfer image-receiving sheet which can perform high speed recording and also form a transferred image of high density and high resolution without use of a conventional release agent, and yet has excellent oil resistance of the image formed such as fingerprint resistance and plasticizer resistance, etc.

As the method for giving excellent mono-color or full-color images simply and at high speed in place of the general letter printing method or printing method of the prior art, the ink jet system, the heat transfer system, etc. have been developed. Among them, as the system which can give full-color images having excellent continuous gradation comparable with color photography, the so called sublimation heat transfer system by use of a sublimable dye is the most excellent.

The heat dye transfer sheet used in the above-mentioned sublimation type heat transfer system generally employed is one having a dye layer containing a sublimable dye formed on one surface of a substrate sheet such as polyester film, etc., while on the other hand, having a heat resistant layer provided on the other surface of the substrate sheet for prevention of sticking of the thermal head.

By superposing the dye layer surface of a such heat dye transfer sheet on the heat transfer image-receiving sheet having an image-receiving layer comprising a polyester resin, etc., and heating imagewise from the back surface of the heat dye transfer sheet with a thermal head, the dye in the dye layer is migrated to the heat transfer image-receiving sheet to form a desired image.

In the heat transfer system as described above, there is an excellent advantage that the density of the image can be exhibited depending on the temperature of the thermal head. However, when the temperature of the thermal head is increased for making the density higher, the binder forming the dye layer is softened and stick to the image-receiving sheet, thus causing an inconvenience that the heat transfer sheet and the image-receiving sheet are adhered. In an extreme case such adherence results in a problem that the dye layer is peeled off during peeling of the heat transfer and image-receiving sheets to be transferred onto the image-receiving sheet surface.

As the method for solving such problem, it has been practiced to incorporate a release agent such as silicone oil, etc. in the dye receiving layer of the image-receiving sheet. However, since said silicone oil is liquid at room temperature, it has the drawback that it bleeds out onto the surface of the receiving layer during storage to cause such problem as blocking or contamination. On the other hand, there are also methods in which a thermosetting silicone oil is used, but in these methods, heating is required after formation of the receiving layer, whereby there is the problem that the production steps are very cumbersome.

Further, if a relatively large amount of silicone is added for giving sufficient releasability to the receiving layer, there ensues such problems that dye receptivity is lowered or the image-receiving sheet is discolored to adversely affect storability.

Also, although the above-mentioned methods have excellent peelability, there is involved the problem that when the image obtained is touched with fingers, fingerprints are transferred, and the dye where the fingerprints are transferred is discolored. Also, when such image is brought into contact with a polyvinyl chloride resin containing a plasticizer or a plastic erasing rubber containing a plasticizer, the dye is migrated which causes the image to be similarly discolored.

SUMMARY OF THE INVENTION

Accordingly, an object of the present invention is to provide a heat transfer image-receiving sheet, which is excellent in peelability during heat transfer, capable of high speed recording, and also can form a transferred image of high density and high resolution excellent in oil resistance such as fingerprint resistance or plasticizer resistance.

The above object can be accomplished by the present invention as specified below.

More specifically, the present invention is a heat transfer image-receiving sheet having a dye receiving layer provided on the surface of a substrate sheet, said dye receiving layer comprising a graft copolymer having at least one releasing segment selected from the group consisting of polysiloxane segments, fluorinated carbon segments and long chain alkyl segments graft bonded to the main chain in the graft copolymer.

DETAILED DESCRIPTION OF THE INVENTION

By forming the dye receiving layer of a polymer with good dyeability having releasing segments grafted thereon, an image-receiving sheet excellent in releasability, dye dyeability and plasticizer resistance-fingerprint resistance can be obtained without use of a release agent.

Figure 1:
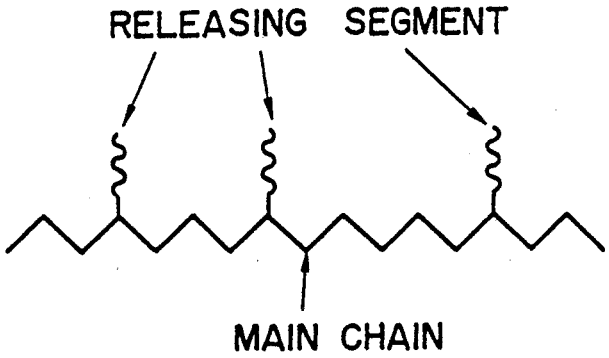
FIG. 1 is a conceptional view representing schematically the graft copolymer to be used in the dye receiving layer in the image-receiving sheet of the present invention.

More specifically, the polymer for forming the dye receiving layer in the present invention is a polymer having at least one releasing segment, which may be schematically shown as in FIG. 1, comprising releasing segments graft bonded as the side chains to the polymer which is the main chain.

Figure 2:
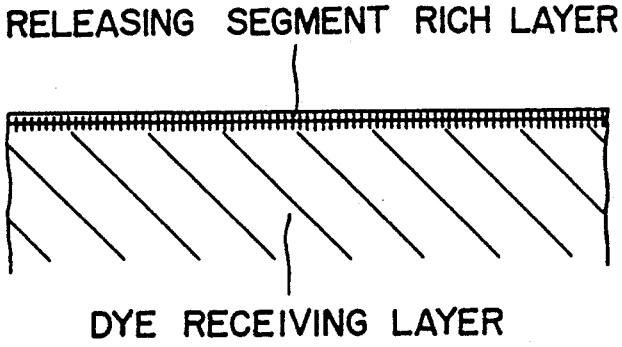
FIG. 2 is a schematic illustration representing the surface state of the dye receiving layer.

Such releasing segment of polymer itself is generally low in compatibility with the main chain of a polymer. Therefore, if a dye receiving layer is formed from such polymer, the releasing segments are micro-phase separated from the dye receiving layer, tending to bleed on the surface of the dye receiving layer. On the other hand, the main chain is adhered integrally to the substrate sheet. These actions in concert to make the releasing segments rich on the surface of the dye receiving layer as shown in FIG. 2, whereby good releasability can be exhibited. However, the releasing segments will not be departed from the dye receiving layer owing to the main chain, and therefore the releasing segments will not be migrated to the surface of another article.

Also, by selecting one with good dyeability as the main chain, excellent dyeability can be imparted thereto.

Referring now to a preferred embodiment, the present invention is described in more detail.

The heat transfer image-receiving sheet of the present invention comprises a substrate sheet and a dye receiving layer provided from a releasing graft copolymer on at least one surface thereof.

As the substrate sheet to be used in the present invention, there can be used synthetic paper (polyolefin type, polystyrene type, etc.), pure paper, art paper, coated paper, cast coated paper, wall paper, paper for backing, synthetic resin or emulsion impregnated paper, synthetic rubber latex impregnated paper, synthetic rubber latex impregnated paper, synthetic resin internally added paper, plate paper, cellulose paper, films or sheets of plastics such as polyolefin, polyvinyl chloride, polyethylene terephthalate, polystyrene, polymethacrylate, polycarbonate, etc. Also, white opaque films formed with addition of a white pigment or filler to these synthetic resins or expanded sheets, etc. can be also used without particular limitation. Also, laminates according to any desired combination of the above substrates can be used. As a representative of the laminate, a laminate of a cellulose fiber paper and a synthetic paper or a cellulose fiber paper and a plastic film or sheet may be employed. The thickness of these substrates sheets may be any desired one, for example, generally about 10 to 300 μm.

The substrate sheet as described above, when it is poor in adhesive force to the receiving layer to be formed on its surface, should preferably be applied with the primer treatment or the corona discharging treatment on its surface.

As the primer treatment, any treatment which can consolidate adhesion between the dye receiving layer and the substrate may be used. For example, a polyester resin, a polyurethane resin, an acrylic polyol resin, a vinyl chloride-vinyl acetate copolymer resin, etc. may be used alone or in a mixture by way of coating. Also, if necessary, a reactive curing agent such as polyisocyanate, etc. may be added. Further, a titanate and a silane type coupling agent may be also used. Also, if necessary, two or more layers may be laminated.

The dye receiving layer to be formed on the above substrate sheet is provided for receiving the sublimable dye migrated from the heat transfer sheet and maintaining the image formed.

In the present invention, the polymer for forming the dye receiving layer is a graft copolymer having at least one releasing segment selected from polysiloxane segments, fluorinated carbon segments and long chain alkyl segments graft bonded to the main chain.

As the polymer for the main chain, any polymer having reactive functional groups known in the art may be available. Preferable examples may include cellulose type resins such as ethyl cellulose, hydroxyethyl cellulose, ethylhydroxy cellulose, hydroxypropyl cellulose, methyl cellulose, cellulose acetate, cellulose acetate butyrate, etc., acrylic resins, vinyl type resins such as polyvinyl alcohol, polyvinyl chloride, vinyl chloride-vinyl acetate copolymer, polyvinylidene chloride, polyvinyl butyral, polyvinyl acetal, polyvinyl pyrrolidone, etc., polyamide type resins such as nylon, polyacrylamide, etc., polyurethane type resins, polycarbonate, polyester type resins, and copolymers of those resins, etc. Among them, with respect to dyeability, acrylic, vinyl, polyester, polyurethane, polyamide or cellulose type resins are particularly preferred. More preferably, acrylic-urethane type resins, vinyl chloride-acrylic type copolymer may be employed.

The releasing segment graft copolymer to be used in the present invention can be synthesized according to various methods, and one preferable method is the method in which, after formation of the main chain, the functional group existing in the main chain is reacted with a releasing compound having a functional group reactive therewith.

As an example of the releasing compounds having such functional group as mentioned above, the following compounds may be included.

(a) Polysiloxane compounds:

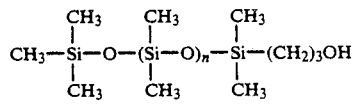
(1)

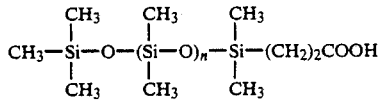
(2)

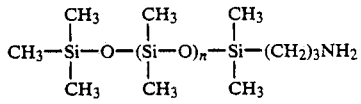
(3)

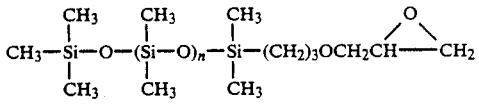
(4)

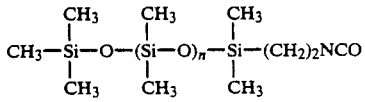
(5)

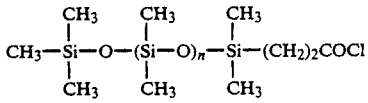
(6)

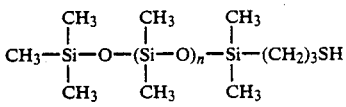
(7)

In the above formulae, a part of the methyl group may be also substituted with other alkyl groups, aromatic groups such as phenyl group, etc., halogen etc. .

(b) Fluorinated carbon compounds:

$C_8F_{17}C_2H_4OH$ (8)

$C_6F_{13}C_2H_4OH$ (9)

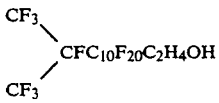
(10)

$C_8F_{17}C_2H_4OH$ (11)

$C_{10}F_{21}C_2H_4OH$ (12)

$C_8F_{17}SO_2N(C_2H_5)C_2H_4OH$ (13)

-continued (b) Fluorinated carbon compounds:

$C_8F_{17}SO_2N(C_2H_5)C_2H_4OH$ (14)

$C_6F_{13}COOH$ (15)

$C_6F_{13}COCl$ (16)

$C_8F_{17}C_2H_4SH$ (17)

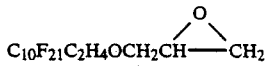
(18)

Higher fatty acids such as lauric acid, myristic acid, plamitic acid, stearic acid, oleic acid, linoleic acid, etc., and acid halides thereof, higher alcohols such as nonyl alcohol, capryl alcohol, lauryl alcohol, myristyl alcohol, cetyl alcohol, stearyl alcohol, oleyl alcohol, linoleyl alcohol, ricinoleyl alcohol, etc., higher aldehydes such as capric aldehyde, lauric aldehyde, myristic aldehyde, stearic aldehyde, etc., higher amines such as decylamine, laurylamine, cetylamine, etc.

The above-mentioned examples are merely exemplary, and other various reactive releasable compounds are available from Shinetsu Kagaku K. K., Japan or others, and any of them is available in the present invention. Particularly preferred is a monofunctional releasable compound having one functional group in one molecule, and use of a polyfunctional compound having two or more functionalities is not preferable because the graft copolymer tends to be gelled.

The relationship between the above-mentioned functional releasing compound and the resin as exemplified above is as shown below in Table 1, when the functional group of the releasing compound is represented by X, while the functional group of the main chaine polymer is represented by Y. Of course, the relationship of X and Y may be vice versa, or respective groups may be used in a mixture, and these examples are not limitative, provided that both are reactive with each other.

TABLE 1

| X | Y |
|---|---|
| —NCO | —OH, —$NH_2$, —NHR—, —COOH, —SH, etc. |
| —COCl | —OH, —$NH_2$, —NHR—, —SH, etc. |
| 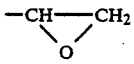 | —OH, —$NH_2$, —COOH, etc. |
| 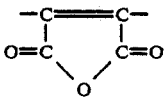 | —OH, —$NH_2$, —NHR—, —SH, etc. |
| —OH, —SH | 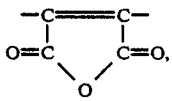 —NCO, COOR, —CHO, —COCl, —COOH, etc. |
| —$NH_2$, —NHR— | 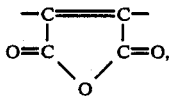 —NCO, —COOH, COCl, 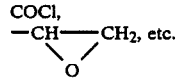 etc. |

TABLE 1-continued

| X | Y |
|---|---|
| —COOH | 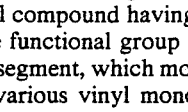 —NCO, —OH, —$NH_2$, —NHR—, etc. |

As another preferred preparation method, the above-mentioned functional releasing compound is allowed to react with a vinyl compound having a functional group reactive with the functional group to form a monomer having releasing segment, which monomer can be copolymerized with various vinyl monomers to give similarly a desired graft copolymer.

As still another preferred preparation method, it is possible to use the method, in which to a polymer having an unsaturated double bond in its main chain such as an unsaturated polyester, a copolymer of a vinyl monomer and a diene compound such as butadiene, etc., the mercapto compound such as the above exemplary compound (7) or the above-mentioned releasing vinyl compound is added to be grafted thereon.

The above methods are examples of preferred preparation methods, and in the present invention, graft copolymers prepared according to other methods can be used as a matter of course.

The content of the releasing segments in the above polymer should be preferably within the range of 3 to 60% by weight of the releasing segments occupied in the polymer. If the amount of the segments is too small, releasability is insufficient, while if it is too much, dyeability and the coating strength may be lowered, and also the problem of discoloration or storability of the dye will undesirably occur.

The above resins can be used either individually or as a mixture, and further when the content of silicone segments is much, adhesiveness of the dye receiving layer to the substrate film may be sometimes inferior, and therefore, it is preferable to use a dye dyeable resin known in the art in combination, for example, polyolefinic resins such as polypropylene, etc., halogenated polymers such as polyvinyl chloride, polyvinylidene chloride, etc., vinyl polymers such as polyvinyl acetate, polyacrylic ester, etc., polyester resins such as polyethylene terephthalate, polybutylene terephthalate, etc., polystyrene resins, polyamide resins, copolymer resins of an olefin such as ethylene, propylene, etc., with other vinyl monomers, ionomers, cellulose resins such as cellulose diacetate, etc., polycarbonate and others. Particularly preferable are vinyl resins and polyester resins. When they are used in combination, the above-mentioned graft copolymer should preferably a ratio such that the releasing segments comprise 3 to 60% by weight in the whole resin. Also, by providing a second layer as the receiving layer of the present invention on the upper surface of a dye receiving layer of the prior art as a first layer, adhesion between the receiving layer and the substrate can be improved.

When the above graft copolymer receiving layer resin and another resin are used in combination, although adhesion to the substrate film may be excellent, peelability during heat transfer may be inferior in some cases. In such cases, peelability can be improved by addition of a silicone type release agent. As such silicone type release agent, in addition to conventional silicone oils, silicone waxes, modified silicone oils such as epoxy-modified, alkyl-modified, amino-modified, carboxyl-modified, alcohol-modified, fluorine-modified, alkyl aralkyl polyether-modified, epoxy-polyether-modified, polyether-modified silicone oils, etc. are particularly desirable.

One kind or two or more kinds of the release agents as described above may be employed. The amount of the release agent added may be preferably 1 to 20 parts by weight based on 100 parts by weight of the total resin forming the dye receiving layer. If the amount added is less than this range, peelability during heat transfer as mentioned above, while if it is too much, the problem such as stickiness or discoloration of dye image will occur.

The heat transfer image-receiving sheet of the present invention can be obtained by coating and drying a solution of the resin as described above added with necessary additives dissolved in an appropriate organic solvent or a dispersion dispersed in water on at least one surface of the above-mentioned substrate film by formation means such as gravure printing, screen printing, reverse roll coating by use of a gravure plate, etc. to form a dye receiving layer.

In forming the above receiving layer, for the purpose of enhancing the sharpness of the transferred image by improvement of the whiteness of the receiving layer, a pigment or filler such as titanium oxide, zinc oxide, kaolin clay, calcium carbonate, fine powdery silica, etc. can be added. Also, for further enhancing discoloration and fading resistance, particularly indoor discoloration and fading resistance and dark place discoloration and fading resistance, of the transferred image formed on the receiving layer, UV-ray absorber, photo stabilizer or antioxidant can be added in the receiving layer.

The dye receiving formed as described above may have any desired thickness, but generally a thickness of 1 to 50 μm. Also, such dye receiving layer may be preferably a continuous coating, but it may be also formed as an incontinuous coating by use of a resin emulsion or a resin dispersion.

Also, the image-receiving sheet of the present invention is applicable to various uses such as image-receiving sheets, cards, sheets for preparation of transparent type originals capable of heat transfer recording, etc. by selecting suitably the substrate film.

Further, the image-receiving sheet of the present invention can have a cushioning layer provided between the substrate film and the receiving layer, if necessary, and by provision of such cushioning layer, an image corresponding to the image information with little noise can be transferred and recorded during printing with good reproducibility.

As the material constituting the cushioning layer, for example, polyurethane resin, acrylic resin, polyethylene resin, butadiene rubber, epoxy resin, polyvinyl chloride resin, vinyl chloride-vinyl acetate copolymer, etc. may be employed. The thickness of the cushioning layer may be preferably about 2 to 20 μm.

It is also possible to provide a lubricating layer on the back surface of the substrate film. As the material for the lubricating layer, methacrylate resin such as of methyl methacrylate or corresponding acrylate resin, vinyl resin such as vinyl chloride-vinyl acetate copolymer, polyvinyl alcohol, polyvinyl acetal, cellulose derivatives, etc. may be employed.

Further, a detection mark can be also provided on the image-receiving sheet. Detection mark is very convenient in performing registration between the heat transfer sheet and the image-receiving sheet, etc., and, for example, a detection mark which can be detected by a photoelectric tube detecting device can be provided on the back surface, etc. of the substrate film by way of printing, etc.

A particularly preferable example of the resin for forming the dye receiving layer in the present invention is an acrylic urethane silicone resin. The acrylic urethane silicone resin in this case may also further have fluorinated carbon group. These acrylic urethane silicone resins are those having alkoxy silane compounds reacted with acrylic resins modified with urethane resins to have pendant alkoxysilyl groups bound thereto. By use of the acrylic urethane resin for the main chain, a receiving layer with very good dyeability can be obtained.

The acrylic urethane silicone resin can be also easily prepared and used, or alternatively available from the market with such trade names as UA-53F (fluorine containing acrylic urethane silicone resin, manufactured by Sanyo Kasei Kogyo, Japan), UA-40 (acrylic urethane silicone resin, manufactured by Sanyo Kasei Kogyo, Japan), TT-50H (acrylic urethane silicone resin, manufactured by Sanyo Kasei Kogyo, Japan), SF18B (fluorine containing acrylic urethane silicone resin, manufactured by Sanyo Kasei Kogyo, Japan), etc. These resins can be cured with an organometallic compound of tin, titanium, etc., an acid, humidity, etc. as the catalyst during use. By curing, heat resistance can be further improved and also a receiving layer with luster can be obtained.

In the above-mentioned acrylic urethane silicone resin, if the amount of acrylic segments is too small, shortage of dye receptivity occurs, while if the amount of silicone segments is too small, shortage of releasability occurs. On the other hand, if the amount of urethane segments is in shortage, shortage of adhesion or dyeability to the substrate film occurs. Therefore, preferable weight ratio of acrylic segments:urethane segments:silicone segments is within the range of 10 to 80:10 to 80:10 to 50.

A particularly preferable polymer for the main chain is a copolymer of vinyl chloride, a (meth)acrylic acid type monomer and a polymer having a vinyl group at the terminal end. Examples of the (meth)acrylic acid (this word is inclusive of both acrylic acid and methacrylic acid) type monomers may include (meth)acrylic acid, methyl (meth)acrylate, ethyl (meth)acrylate, propyl (meth)acrylate, butyl (meth)acrylate, 2-ethylhexyl (meth)acrylate, 2-ethoxyethyl (meth)acrylate, 2-hydroxyethyl (meth)acrylate, n-stearyl (meth)acrylate, tetrahydrofurfuryl (meth)acrylate, glycidyl (meth)acrylate and the like. When, a releasing compound is grafted after formation of the main chain as described above, a monomer having a functional group such as hydroxyl group, glycidyl group, carboxyl group, etc. can be used as a part of the above monomers. By use of the above polymer for the main chain, a receiving layer having very excellent dyeability and storability of the dye image obtained such as light resistance, etc. can be obtained.

As the polymer having vinyl group at the terminal end, those having vinyl ester groups or (meth)acrylate groups introduced at the terminal ends of polymers such as polystyrene, styrene/acrylonitrile copolymer, polyester, polyvinyl chloride, polyvinyl acetate, vinyl chloride/vinyl acetate copolymer, polyamide, poly(meth)acrylate, etc., are available variously from the market under the general name of macromer, and all of them can be used in the present invention. These polymers may preferably have molecular weights of about 1,000 to 15,000.

The copolymerization ratio of these main chain copolymers may be any desired one, but a preferable range may be 30 to 90/5 to 60/3 to 20 in terms of the weight ratio of vinyl chloride, (meth)acrylic acid type monomer and the polymer having vinyl group at the terminal end. Outside of the above range, both preferable properties of dye dyeability, light resistance, etc. can be obtained with difficulty. Of course, a small amount of other monomer units than the monomers as mentioned above can be also contained.

These copolymers can be prepared easily according to emulsion polymerization, suspension polymerization, mass polymerization, solution polymerization, etc. known in the art, and also various kinds of grades are available from the market and all can be used in the present invention. A preferable range of the molecular weight is about from 5,000 to 40,000.

According to the present invention as described above, by forming the dye receiving layer of a specific resin, an image-receiving sheet having excellent releasability, dyeability, adhesion to the substrate and cushioning characteristic can be obtained without use of a release agent.

Therefore, according to the present invention, fusion with the heat transfer sheet can be prevented without use of the release agent of the prior art which causes various problems, and a heat transfer image-receiving sheet capable of forming an image of high density and high resolution at high speed and excellent in oil resistance such as fingerprint resistance, plasticizer resistance, etc. can be provided.

The present invention is described below in more detail by referring to Reference examples, Examples and Comparative examples. In the sentences, parts and % are based on weight, unless otherwise particularly noted.

REFERENCE EXAMPLE A1

Forty (40) parts of a copolymer of 95 mole % of methyl methacrylate and 5 mole % of hydroxyethyl methacrylate (molecular weight: 120,000) were dissolved in 400 parts of a solvent mixture of equal amounts of methyl ethyl ketone and toluene, then 10 parts of the polysiloxane compound (5) as exemplified above (molecular weight: 3,000) were added gradually dropwise to the resultant solution and the reaction was carried out at 60° C. for 5 hours. The product was found to be a uniform product, and the polysiloxane could not be separated according to the fractional precipitation method, thus indicating that it was formed between the reaction of the polysiloxane compound and the acrylic resin. By analysis, the amount of the polysiloxane segments was about 7.4%.

REFERENCE EXAMPLE A2

Fifty (50) parts of a polyvinyl butyral (polymerization degree: 1,700, hydroxyl content: 33 mole %) were dissolved in 500 parts of a solvent mixture of equal amounts of methyl ethyl ketone and toluene, then 10 parts of the polysiloxane compound (5) as exemplified above (molecular weight: 3,000) were added gradually dropwise to the resultant solution and the reaction was carried out at 60° C. for 5 hours. The product was found to be a uniform product, and the polysiloxane could not be separated according to the fractional precipitation method, thus indicating that it was formed between the reaction of the polysiloxane compound and the polyvinyl butyral resin. By analysis, the amount of the polysiloxane segments was about 5.2%.

REFERENCE EXAMPLE A3

Seventy (70) parts of a polyester comprising 45 mole % of dimethyl terephthalate, 5 mole % of dimethyl monoamino-terephthalate and 50 mole % of trimethylene glycol (molecular weight: 25,000) were dissolved in 700 parts of a solvent mixture of equal amounts of methyl ethyl ketone and toluene, then 10 parts of the polysiloxane compound (5) as exemplified above (molecular weight 10,000) were added gradually dropwise to the resultant solution and the reaction was carried out at 60° C. for 5 hours. The product was found to be a uniform product, and the polysiloxane could not be separated according to the fractional precipitation method, thus indicating that it was formed between the reaction of the polysiloxane compound and the polyester resin. By analysis, the amount of the polysiloxane segments was about 5.4%.

REFERENCE EXAMPLE A4

Eighty (80) parts of a polyurethane resin obtained from polyethylene adipate diol, butane diol and hexamethylene diisocyanate (molecular weight 6,000) were dissolved in 800 parts of a solvent mixture of equal amounts of methyl ethyl ketone and toluene, then 10 parts of the polysiloxane compound (6) as exemplified above (molecular weight: 2,000) were added gradually dropwise to the resultant solution and the reaction was carried out at 60° C. for 5 hours. The product was found to be a uniform product, and the polysiloxane could not be separated according to the fractional precipitation method, thus indicating that it was formed between the reaction of the polysiloxane compound and the polyurethane resin. By analysis, the amount of the polysiloxane segments was about 4.0%.

REFERENCE EXAMPLE A5

One hundred (100) parts of a mixture of 5 mole % of a monomer obtained by the reaction between the above-mentioned polysiloxane compound (3) (molecular weight 1,000) and methacrylic acid chloride at a molar ratio of 1:1, 45 mole % of methyl methacrylate, 40 mole % of butyl acrylate and 10 mole % of styrene and 3 parts of azobisisobutyronitrile were dissolved in 1,000 parts of a solvent mixture of equal amounts of methyl ethyl ketone and toluene, and polymerization was carried out at 70° C. for 6 hours to obtain a viscous polymerized solution. The product was a uniform product, and the polysiloxane compound could not be separated by the fractional separation method. By analysis, the amount of the polysiloxane segments was about 6.1%.

REFERENCE EXAMPLE A6

Fifty (50) parts of a styrene-butadiene copolymer (molecular weight: 150,000, butadiene: 10 mole %) and 2 parts by weight of azobisisobutyronitrile were dissolved in 500 parts of a solvent mixture of equal amounts of methyl ethyl ketone and toluene, then 10 parts of the polysiloxane compound (7) as exemplified above (molecular weight: 10,000) were added gradually dropwise to the resultant solution and the reaction was carried out at 60° C. for 5 hours. The product was found to be a uniform product, and the polysiloxane could not be separated according to the fractional precipitation method, thus indicating that it was formed between the reaction of the polysiloxane compound and the copolymer. By analysis, the amount of the polysiloxane segments was about 6.2%.

REFERENCE EXAMPLE A7

Eighty (80) parts of hydroxyethyl cellulose were dissolved in 800 parts of a solvent mixture of equal amounts of methyl ethyl ketone and toluene, then 10 parts of the polysiloxane compound (6) as exemplified above (molecular weight 2,000) (5) as exemplified above (molecular weight: 3,000) were added gradually dropwise to the resultant solution and the reaction was carried out at 60° C. for 5 hours. The product was found to be a uniform product, and the polysiloxane could not be separated according to the fractional precipitation method, thus indicating that it was formed between the reaction of the polysiloxane compound and the hydroxyethyl cellulose. By analysis, the amount of the polysiloxane segments was about 5.8%.

REFERENCE EXAMPLE A8

A releasing graft copolymer was obtained in the same manner as in Reference example Al except for using the fluorinated carbon compound (16) as exemplified above in place of the polysiloxane compound in Reference example A1.

REFERENCE EXAMPLE A9

A releasing graft copolymer was obtained in the same manner as in Reference example A2 except for using the fluorinated carbon compound (18) as exemplified above in place of the polysiloxane compound in Reference example A2.

REFERENCE EXAMPLE A10

A releasing graft copolymer was obtained in the same manner as in Reference example A5 except for using the methacrylate of fluorinated carbon compound (10) as exemplified above in place of the polysiloxane compound in Reference example A5.

REFERENCE EXAMPLE A11

A releasing graft copolymer was obtained in the same manner as in Reference example A5 except for using lauryl aminoacrylate in place of the polysiloxane compound in Reference example A5.

REFERENCE EXAMPLE A12

A releasing graft copolymer was obtained in the same manner as in Reference example A5 except for using a mixture of equal amounts of the vinyl stearate and the methacrylate of the fluorinated carbon compound (14) in place of the polysiloxane compound in Reference example A5.

EXAMPLES A1 to A12

By use of a synthetic paper (Yupo-FRG-150, thickness 150 μm, manufactured by Oji Yuka, Japan) as the substrate, a coating solution with a composition shown below was coated by a bar coater and dried at a ratio which became 5.0 g/m$^2$ on drying to obtain a heat transfer image-receiving sheet of the present invention.

COMPOSITION FOR RECEIVING LAYER:

Graft copolymer of reference example 15.0 parts

| Composition for receiving layer: | |
|---|---|
| Graft copolymer of reference example | 15.0 parts |
| Solvent (butyl acetate/copolymer/xylene) (2/1/2) | 85.0 parts |

COMPARATIVE EXAMPLE A1

A heat transfer image-receiving sheet of Comparative example was obtained in the same manner as in Examples except for using 4.0 parts of a copolymer of 95 mole % of methyl methacrylate and 5 mole % of hydroxyethyl methacrylate and 0.3 part of a silicone oil (trade name KF-96, manufactured by Shinetsu Kagaku Kogyo, Japan) in place of the graft copolymer in Examples.

COMPARATIVE EXAMPLE A2

A heat transfer image-receiving sheet of Comparative example was obtained in the same manner as in Examples except for using 4.0 parts of a polyvinyl butyral (polymerization degree: 1,700, hydroxyl content: 33 mole in place of the graft copolymer in Examples.

COMPARATIVE EXAMPLE A3

A heat transfer image-receiving sheet of Comparative example was obtained in the same manner as in Examples except for using styrene-butadiene copolymer (molecular weight: 150,000, butadiene: 10 mole %) in place of the graft copolymer in Examples.

An ink composition for formation of dye layer as shown below was prepared and coated on one surface thereof by a wire bar and dried to a dry coated amount of 1.0 g/m$^2$ on a polyethylene terephthalate film with a thickness of 6 μm applied with heat-resistant treatment on the back surface to obtain a heat transfer sheet.

| | |
|---|---|
| Disperse dye (Kayaset Blue 714, C.I. Solvent Blue 63, manufactured by Nippon Kayaku, Japan) | 4.0 parts |
| Polyvinyl butyral resin (Ethlec BX-1, manufactured by Sekisui Kagaku, Japan) | 4.3 parts |
| Methyl ethyl ketone/toluene (weight ratio 1/1) | 80.0 parts |
| Isobutanol | 10.0 parts |

The heat transfer image-receiving sheet as previously described and the above heat transfer sheet were superposed with the respective dye layer and the dye receiving surface opposed to each other, and recording was performed with a thermal head from the back surface of the heat transfer sheet by means of a heat-sensitive sublimation transfer printer (VY-50, manufactured by Hitachi Seisakusho K. K., Japan) at a printing energy of 90 mJ/mm$^2$, to obtain the results shown below in Table 2.

TABLE 2

| | Example | | | | | | | | | | | | Comparative Example | | |
|---|---|---|---|---|---|---|---|---|---|---|---|---|---|---|---|
| | A1 | A2 | A3 | A4 | A5 | A6 | A7 | A8 | A9 | A10 | A11 | A12 | A1 | A2 | A3 |
| Adhesion to substrate | Δ | Δ | Δ | Δ | Δ | O | Δ | O | O | O | O | O | O | O | O |
| Releasability | O | O | O | O | O | O | O | O | O | O | O | O | Δ | X | X |

TABLE 2-continued

| | Example | | | | | | | | | | | | Comparative Example | | |
|---|---|---|---|---|---|---|---|---|---|---|---|---|---|---|---|
| | A1 | A2 | A3 | A4 | A5 | A6 | A7 | A8 | A9 | A10 | A11 | A12 | A1 | A2 | A3 |
| White dropout of printed matter | Δ | Δ | O | O | O | O | Δ | O | O | O | O | O | Δ | Δ | O |
| Storability of printed dye image | O | O | O | O | O | O | O | O | O | O | O | O | Δ | O | X |
| Fingerprint resistance | O | O | O | O | O | O | O | O | O | O | O | O | X | X | X |
| Printing density | 0.95 | 0.96 | 0.94 | 1.08 | 1.00 | 0.98 | 0.95 | 0.99 | 0.98 | 1.01 | 1.03 | 1.00 | 1.00 | 0.97 | 1.10 |

Evaluation standards

Adhesion to substrate: The cross-cut test was conducted as described below. On the receiving layer surface of the heat transfer image-receiving sheet was cut a streak with a width of 1 mm so that 10×10 checkers of 1 mm square could be made, and after an adhesive tape (Cellotape No. 405-P, manufactured by Nichiban K. K., Japan) was pressed firmly thereon, the tape was strongly peeled off, and the number of checkers peeled was counted.

O: no peeling

Δ: partially peeled but practically without problem x: 50% or more peeled

Releasability: The heat transfer sheet and the heat transfer image-receiving sheet after printing were manually peeled off.

O: easily peeled without problem

Δ: slightly adhered but there is no problem to use x: difficultly released, and a part of the dye layer was fused with the receiving layer to be transferred peeled from the substrate White drop-out: Solid printed portion was examined by microscope.

O: no drop-out

Δ: partial white drop-out x: 10% or more white drop-out

Storability of printed dye image: Printed portion after left to stand at 40° C. and 90% RH for 200 hours was observed with naked eyes.

O: no change

Δ: slightly blurred x: blurred

Printing density: Relative optical density when that of Comparative Example B1 is made 1.00.

Fingerprint resistance: finger print is attached on the printed portion, and the printed portion after left to stand at 50° C. (dry) for 48 hours is observed with naked eyes.

O: no change x: the portion attached with fingerprint discolored or faded.

REFERENCE EXAMPLE B1

Forty (40) parts of a vinyl chloride/n-butyl acrylate/-hydroxyethyl methacrylate/vinyl-modified polystyrene copolymer (copolymerization weight ratio = 75/10/5/10) (molecular weight: 120,000) were dissolved in 400 parts of a solvent mixture of equal amounts of methyl ethyl ketone and toluene, then 10 parts of the polysiloxane compound (5) as exemplified above (molecular weight: 3,000) were gradually added dropwise, and the reaction was carried out at 60° C. for 5 hours. The product was found to be a uniform product, and the polysiloxane could not be separated according to the fractional precipitation method, thus indicating that it was formed between the reaction of the polysiloxane compound and the main chain polymer. By analysis, the amount of the polysiloxane segments was about 7.4%.

REFERENCE EXAMPLE B2

A releasing graft copolymer was obtained in the same manner as in Reference example B1 except for using the exemplary compound (4) as mentioned above in place of the polysiloxane compound in Reference example B1.

REFERENCE EXAMPLE B3

A releasing graft copolymer was obtained in the same manner as in Reference example B1 except for using a mixture of the exemplary compounds (4) and (18) as mentioned above in place of the polysiloxane compound in Reference example B1.

REFERENCE EXAMPLE B4

One hundred (100) parts of a monomer mixture of vinyl chloride/methyl methacrylate/vinyl-modified acrylonitrile-styrene copolymer/methacrylate of the above polysiloxane compound (3) (molecular weight 1,000) (weight mixing ratio = 75/10/10/5) and 3 parts of azobisisobutyronitrile were dissolved in 1,000 parts of a solvent mixture of equal amounts of methyl ethyl ketone and toluene, and polymerization was carried out at 70° C. for 6 hours to obtain a viscous polymerized solution. The product was found to be a uniform product, and the polysiloxane could not be separated according to the fractional precipitation method. By analysis, the amount of the polysiloxane segments was about 4.9%.

REFERENCE EXAMPLE B5

A releasing graft copolymer was obtained in the same manner as in Reference example B4 except for using the acrylate of the exemplary compound (8) as mentioned above in place of the polysiloxane compound in Reference example B4.

REFERENCE EXAMPLE B6

A releasing graft copolymer was obtained in the same manner as in Reference example B4 except for using the acrylate of the exemplary compound (10) as mentioned above in place of the polysiloxane compound in Reference example B4.

REFERENCE EXAMPLE B7

A releasing graft copolymer was obtained in the same manner as in Reference example B4 except for using a mixture of equal amounts of the methacrylate of the exemplary compound (1) and the methacrylate of the compound (14) as mentioned above in place of the polysiloxane compound in Reference example B4.

REFERENCE EXAMPLE B8

A releasing graft copolymer was obtained in the same manner as in Reference example B4 except for using lauryl aminoacrylate in place of the polysiloxane compound in Reference example B4.

REFERENCE EXAMPLE B9

A releasing graft copolymer was obtained in the same manner as in Reference example B1 except for using a vinyl chloride/n-butyl acrylate/glycidyl methacrylate/vinyl-modified polymethyl methacrylate copolymer (copolymerization weight ratio = 77/10/5/8) (molecular weight 100,000) in place of the main chain polymer in Reference example B1 and a mixture of equal amounts of the exemplary compound (10) and stearyl alcohol as the releasable compound.

REFERENCE EXAMPLE B10

A releasing graft copolymer was obtained in the same manner as in Reference example B1 except for using a vinyl chloride/n-butyl acrylate/p-aminostyrene/vinyl-modified polymethyl methacrylate copolymer (copolymerization weight ratio = 70/10/10/10) (molecular weight 150,000) in place of the main chain polymer in Reference example B1 and a mixture of equal amounts of the exemplary compound (6) and stearyl acid chloride as the releasable compound.

EXAMPLES B1 to B10

By use of a synthetic paper (Yupo-FRG-150, thickness 150 μm, manufactured by Oji Yuka, Japan) as the substrate, a coating solution with a composition shown below was coated on one surface thereof by a bar coater and dried at a ratio which became 5.0 g/m$^2$ on drying to obtain a heat transfer image-receiving sheet of the present invention.

| Composition for receiving layer: | |
|---|---|
| Graft copolymer of reference example | 15.0 parts |
| Solvent (butyl acetate/toluene/xylene) (2/1/2) | 85.0 parts |

COMPARATIVE EXAMPLE B1

A heat transfer image-receiving sheet of Comparative example was obtained in the same manner as in Examples except for using 4.0 parts of a copolymer of 95 mole % of methyl methacrylate and 5 mole % of hydroxyethyl methacrylate and 0.3 part of a silicone oil (trade name KF-96, manufactured by Shinetsu Kagaku Kogyo) in place of the graft copolymer in Examples.

COMPARATIVE EXAMPLE B2

A heat transfer image-receiving sheet of Comparative example was obtained in the same manner as in Examples except for using 4.0 parts of a polyvinyl butyral (polymerization degree: 1,700, hydroxyl content: 33 mole %) in place of the graft copolymer in Examples.

COMPARATIVE EXAMPLE B3

A heat transfer image-receiving sheet of Comparative example was obtained in the same manner as in Examples except for using the copolymer used as the starting material in Reference example B1 in place of the graft copolymer in Examples.

An ink composition for formation of dye layer as shown below was prepared and coated by a wire bar and dried to a dry coated amount of 1.0 g/m$^2$ on a polyethylene terephthalate film with a thickness of 6 μm applied with heat-resistant treatment on the back surface to obtain a heat transfer sheet.

| | |
|---|---|
| Disperse dye (Kayaset Blue 714, C.I. Disperse Blue 63, manufactured by Nippon Kayaku, Japan) | 4.0 parts |
| Polyvinyl butyral resin (Ethlec BX-1, manufactured by Sekisui Kagaku, Japan) | 4.3 parts |
| Methyl ethyl ketone/toluene (weight ratio 1/1) | 80.0 parts |
| Isobutanol | 10.0 parts |

The heat transfer image-receiving sheet as previously described and the above heat transfer sheet were superposed with the respective dye layer and the dye receiving surface opposed to each other, and recording was performed with a thermal head from the back surface of the heat transfer sheet by means of a heat-sensitive sublimation transfer printer (VY-50, manufactured by Hitachi Seisakusho K. K., Japan) at a printing energy of 90 mJ/mm$^2$, to obtain the results shown below in Table 3.

TABLE 3

| | Example | | | | | | | | | | Comparative Example | | |
|---|---|---|---|---|---|---|---|---|---|---|---|---|---|
| | B1 | B2 | B3 | B4 | B5 | B6 | B7 | B8 | B9 | B10 | B1 | B2 | B3 |
| Adhesion to substrate | O | O | O | O | O | O | O | O | O | O | O | O | O |
| Releasability | O | O | O | O | O | O | O | O | O | O | Δ | X | X |
| White dropout of printed matter | O | O | O | O | O | O | O | O | O | O | Δ | Δ | O |
| Storability of printed dye image | O | O | O | O | O | O | O | O | O | O | Δ | O | O |
| Fingerprint resistance | O | O | O | O | O | O | O | O | O | O | X | X | X |
| Discoloration of substrate | O | O | O | O | O | O | O | O | O | O | Δ | O | O |
| Light resistance | O | O | O | O | O | O | O | O | O | O | Δ | Δ | O |
| Printing density | 1.00 | 1.00 | 1.02 | 1.10 | 1.00 | 1.05 | 1.02 | 1.15 | 1.08 | 1.12 | 1.00 | 0.97 | 1.20 |

Evaluation standards

Adhesion to substrate: The cross-cut test was conducted as described below. On the receiving layer surface of the heat transfer image-receiving sheet was cut a streak with a width of 1 mm so that 10=10 checkers of 1 mm square could be made, and after an adhesive tape (Cellotape No. 405-P, manufactured by Nichiban K. K., Japan) was pressed firmly thereon, the tape was strongly peeled off, and the number of checkers peeled was counted.

O: no peeling

Δ: partially peeled but practically without problem x: 50% or more peeled

Releasability: The heat transfer sheet and the heat transfer image-receiving sheet after printing were manually peeled off.

O: easily peeled without problem

Δ: slightly adhered but there is no problem to use x: difficultly released, and a part of the dye layer was fused with the receiving layer to be transferred peeled from the substrate.

White drop-out: Solid printed portion was examined by microscope.

O: no drop-out

Δ: partial white drop-out x: 10% or more white drop-out

Discoloration of substrate: No printed portion after left to stand at 80° C. and 90% RH for 200 hours was observed with naked eyes.

O: no change

Δ: slightly discolored in yellow

Storability of printed dye image: Printed portion after left to stand at 40° C. and 90% RH for 200 hours was observed with naked eyes.

O: no change

Δ: slightly blurred x: blurred

Light resistance: According to JIS L 0842, one exceeding the class 3 of the initial fastness in the second exposure method of JIS L 0841 is rated as O, and one not higher than that as Δ.

Fingerprint resistance: finger print is attached on the printed portion, and the printed portion after left to stand at 50° C. (dry) for 48 hours is observed with naked eyes.

O: no change x: the portion attached with fingerprint discolored or faded.

Printing density: Relative optical density when that of Comparative B1 is made 1.00.

EXAMPLE C1

By use of a synthetic paper (Yupo-FRG-150, thickness 150 μm, manufactured by Oji Yuka, Japan) as the substrate, a coating solution with a composition shown below was coated on one surface thereof by a bar coater and dried and cured at 120° C. for 5 min. at a ratio which became 5.0 g/m$^2$ on drying to obtain a heat transfer image-receiving sheet of the present invention.

| | |
|---|---|
| Fluorine containing acryl urethane silicone resin (UA-53F, manufactured by Sanyo Kasei Kogyo K.K., Japan) | 15.0 parts |
| Curing catalyst (Cat. 55, manufactured by Sanyo Kasei Kogyo K.K., Japan) | 1.5 parts |
| Solvent (butyl acetate/toluene/xylene) (2/1/2) | 83.5 parts |

EXAMPLE C2

A heat transfer image-receiving sheet of the present invention was obtained in the same manner as in Example C1 except for using a coating solution having the composition shown below in place of the coating solution in Example C1.

| | |
|---|---|
| Fluorine containing acryl urethane silicone resin (UA-53F, manufactured by Sanyo Kasei Kogyo K.K., Japan) | 10.0 parts |
| Polyester (Vyron 600, manufactured by Toyobo, Japan) | 2.0 parts |
| Vinyl chloride-vinyl acetate copolymer (#1000A, manufactured by Denki Kagaku Kogyo K.K., Japan) | 3.0 parts |
| Curing catalyst (Cat. 55, manufactured by Sanyo Kasei Kogyo K.K., Japan) | 1.5 parts |
| Solvent (methyl ethyl ketone/toluene/xylene) (1/1/2) | 83.5 parts |

EXAMPLE C3

A heat transfer image-receiving sheet of the present invention was obtained in the same manner as in Example C1 except for using a coating solution having the composition shown below in place of the coating solution in Example C1.

| | |
|---|---|
| Acrylic urethane silicone resin (UA-40, manufactured by Sanyo Kasei Kogyo K.K., Japan) | 15.0 parts |
| Curing catalyst (Cat. 55, manufactured by Sanyo Kasei Kogyo K.K., Japan) | 1.5 parts |
| Solvent (Xylene/cellosolve acetate) (4/1) | 83.5 parts |

EXAMPLE C4

A heat transfer image-receiving sheet of the present invention was obtained in the same manner as in Example C1 except for using a coating solution having the composition shown below in place of the coating solution in Example C1.

| | |
|---|---|
| Acrylic urethane silicone resin (UA-40, manufactured by Sanyo Kasei Kogyo K.K., Japan) | 8.0 parts |
| Polyester (Vyron 600, manufactured by Toyobo, Japan) | 7.0 parts |
| Curing catalyst (Cat. 55, manufactured by Sanyo Kasei Kogyo K.K., Japan) | 1.5 parts |
| Solvent (methyl ethyl ketone/xylene/cellosolve acetate) (2/4/1) | 83.5 parts |

EXAMPLE C5

A heat transfer image-receiving sheet of the present invention was obtained in the same manner as in Example C1 except for using a coating solution having the composition shown below in place of the coating solution in Example C1.

| | |
|---|---|
| Fluorine containing acryl urethane silicone resin (UA-53F, manufactured by Sanyo Kasei Kogyo K.K., Japan) | 10.0 parts |
| Polyester (Vyron 600, manufactured by Toyobo, Japan) | 10.0 parts |
| Curing catalyst (Cat. 65MC, manufactured by Sanyo Kasei Kogyo K.K., Japan) | 0.5 parts |
| Amino-modified silicone (X-22-3050C, manufactured by Shinetsu Kagaku Kogyo K.K., Japan) | 0.5 parts |
| Epoxy-modified silicone (X-22-3000E, manufactured by Shinetsu Kagaku Kogyo K.K., Japan) | 0.5 parts |
| Solvent (ethyl acetate/toluene/MEK) (2/1/1) | 88.5 parts |

EXAMPLE C6

A heat transfer image-receiving sheet of the present invention was obtained in the same manner as in Example C1 except for using a coating solution having the composition shown below in place of the coating solution in Example C1.

| | |
|---|---|
| Fluorine containing acryl urethane silicone resin (UA-53F1, manufactured by Sanyo Kasei Kogyo K.K., Japan) | 10.0 parts |
| Curing catalyst (Cat. 55, manufactured by Sanyo Kasei Kogyo K.K., Japan) | 0.5 parts |
| Amino-modified silicone (X-22-3050C, manufactured by Shinetsu Kagaku Kogyo K.K., Japan) | 0.5 parts |
| Epoxy-modified silicone (X-22-3000E, manufactured by Shinetsu Kagaku Kogyo K.K., Japan) | 0.5 parts |
| Solvent (ethyl acetate/toluene/MEK) (2/1/1) | 88.5 parts |

EXAMPLE C7

A heat transfer image-receiving sheet of the present invention was obtained in the same manner as in Example C1 except for using a coating solution having the composition shown below in place of the coating solution in Example C1.

| | |
|---|---|
| Fluorine containing acryl urethane silicone resin (UA-53F1, manufactured by Sanyo Kasei Kogyo K.K., Japan) | 10.0 parts |
| Vinyl chloride-acryl-styrene copolymer | 10.0 parts |
| Curing catalyst (Cat. 55, manufactured by Sanyo Kasei Kogyo K.K., Japan) | 0.5 parts |
| Epoxy-modified silicone (X-22-3000T, manufactured by Shinetsu Kagaku Kogyo K.K., Japan) | 0.5 parts |
| Carboxylic acid-modified silicone (X-22-8706, manufactured by Shinetsu Kagaku Kogyo K.K., Japan) | 0.5 parts |
| Solvent (ethyl acetate/toluene/MEK) (2/1/1) | 88.5 parts |

EXAMPLE C8

A heat transfer image-receiving sheet of the present invention was obtained in the same manner as in Example C1 except for using a coating solution having the composition shown below in place of the coating solution in Example C1.

| | |
|---|---|
| Fluorine containing acryl urethane silicone resin (UA-53F, manufactured by Sanyo Kasei Kogyo K.K., Japan) | 10.0 parts |
| Vinyl chloride-acryl-styrene copolymer | 10.0 parts |
| Catalyst curing type silicone (X-62-1212, manufactured by Shinetsu Kagaku Kogyo K.K., Japan) | 0.5 parts |
| Silicone curing catalyst (PL-50T, manufactured by Sanyo Kasei Kogyo K.K., Japan) | 0.05 parts |
| Solvent (ethyl acetate/toluene/MEK) (2/1/1) | 82.45 parts |

EXAMPLE C9

A heat transfer image-receiving sheet of the present invention was obtained in the same manner as in Example C1 except for using a coating solution having the composition shown below in place of the coating solution in Example C1.

| | |
|---|---|
| Fluorine containing acryl urethane silicone resin (UA-53F, manufactured by Sanyo Kasei Kogyo K.K., Japan) | 5.0 parts |
| Polyester (KA1039-U-18, manufactured by Nippon Gosei Kogyo K.K., Japan) | 8.0 parts |
| Vinyl chloride-vinyl acetate copolymer (#1000A, manufactured by Denki Kagaku Kogyo K.K., Japan) | 5.0 parts |
| Amino-modified silicone (X-22-3050C, manufactured by Shinetsu Kagaku Kogyo K.K., Japan) | 0.5 parts |
| Epoxy-modified silicone (X-22-3000E, manufactured by Shinetsu Kagaku Kogyo K.K., Japan) | 0.5 parts |
| Solvent (ethyl acetate/toluene/MEK) (2/1/1) | 81.0 parts |

COMPARATIVE EXAMPLE C1

A heat transfer image-receiving sheet of comparative example was obtained in the same manner as in Example C1 except for using a coating solution having the composition shown below in place of the coating solution in Example C1.

| | |
|---|---|
| Polyester (Vyron 600, manufactured by Toyobo, Japan) | 4.0 parts |
| Vinyl chloride-vinyl acetate copolymer (#1000A, manufactured by Denki Kagaku Kogyo K.K., Japan) | 6.0 parts |
| Amino-modified silicone (X-22-3050C, manufactured by Shinetsu Kagaku Kogyo K.K., Japan) | 0.2 parts |
| Epoxy-modified silicone (X-22-3000E, manufactured by Shinetsu Kagaku Kogyo K.K., Japan) | 0.2 parts |
| Methyl ethyl ketone/toluene (weight ratio 1:1) | 89.6 parts |

COMPARATIVE EXAMPLE C2

A heat transfer image-receiving sheet of comparative example was obtained in the same manner as in Example C1 except for using a coating solution having the composition shown below in place of the coating solution in Example C1.

| | |
|---|---|
| Acrylic silicone resin (XS-315, manufactured by Toa Gosei Kagaku Kogyo K.K., Japan) | 15.0 parts |
| Solvent (toluene) | 85.0 parts |

COMPARATIVE EXAMPLE C3

A heat transfer image-receiving sheet of comparative example was obtained in the same manner as in Example C1 except for using a coating solution having the composition shown below in place of the coating solution in Example C1.

| | |
|---|---|
| Polyester (Vyron 600, manufactured by Toyobo, Japan) | 10.0 parts |
| Vinyl chloride-vinyl acetate copolymer (#1000A, manufactured by Denki Kagaku Kogyo K.K., Japan) | 8.0 parts |
| Catalyst curing type silicone (X-62-1212, manufactured by Shinetsu Kagaku Kogyo K.K., Japan) | 0.5 parts |
| Silicone curing catalyst (PL-50T, manufactured by Sanyo Kasei Kogyo K.K., Japan) | 0.05 parts |

-continued

| | |
|---|---|
| Solvent (MEK/toluene) | 81.45 parts |

COMPARATIVE EXAMPLE C4

A heat transfer image-receiving sheet of comparative example was obtained in the same manner as in Example C1 except for using a coating solution having the composition shown below in place of the coating solution in Example C1.

| | |
|---|---|
| Polyester (KA1039-U-18, manufactured by Nippon Gosei K.K., Japan) | 15.0 parts |
| Amino-modified silicone (X-22-3050C, manufactured by Shinetsu Kagaku Kogyo K.K., Japan) | 0.5 parts |
| Epoxy-modified silicone (X-22-3000E, manufactured by Shinetsu Kagaku Kogyo K.K., Japan) | 0.5 parts |
| Solvent (MEK/toluene, 1:1) | 84.0 parts |

An ink composition for formation of dye layer as shown below was prepared and coated by a wire bar and dried to a dry coated amount of 1.0 g/m$^2$ on a polyethylene terephthalate film with a thickness of 6 μm applied with heat-resistant treatment on the back surface to obtain a heat transfer sheet.

| | |
|---|---|
| Disperse dye (Kayaset Blue 714, C.I. Disperse Blue 63, manufactured by Nippon Kayaku, Japan) | 4.0 parts |
| Polyvinyl butyral resin (Ethlec BX-1, manufactured by Sekisui Kagaku, Japan) | 4.3 parts |
| Methyl ethyl ketone/toluene (weight ratio 1/1) | 80.0 parts |
| Isobutanol | 10.0 parts |

The heat transfer image-receiving sheet as previously described and the above heat transfer sheet were superposed with the respective dye layer and the dye receiving surface opposed to each other, and recording was performed with a thermal head from the back surface of the heat transfer sheet by means of a heat-sensitive sublimation transfer printer (VY-50, manufactured by Hitachi Seisakusho K. K., Japan) at a printing energy of mJ/mm$^2$, to obtain the results shown below in Table 4.

Discoloration of image-receiving sheet: Non-printed portion after left to stand at 80° C. (dry) for 12 hours was observed with naked eyes.

O: no change x: discolored

Storability of printed dye image: Printed portion after left to stand at 40° C. and 90% RH for 200 hours was observed with naked eyes.

O: no change

Δ: slightly became blurred x: dye image became blurred

Fingerprint resistance: Fingerprint is attached on the printed portion, and the printed portion after left to stand at 50° C. (dry) for 48 hours is observed with naked eyes.

O: no change x: the portion attached with fingerprint discolored or faded

Plasticizer resistance: The printed portion is brought into contact with erasing rubber, and the printed portion after left to stand under a load of 50 g/m$^2$ at room temperature for 12 hours is observed with naked eyes.

O: no coloration of erasing rubber

Δ: erasing rubber slightly colored x: erasing rubber colored

Adhesion to substrate: The cross-cut test was conducted as described below. On the receiving layer surface of the heat transfer image-receiving sheet was cut a streak with a width of 1 mm so that 10×10 checkers of 1 mm square could be made, and after an adhesive tape (Cellotape No. 405-P, manufactured by Nichiban K. K.) was pressed firmly thereon, the tape was strongly peeled off, and the number of checkers peeled was counted.

O: no peeling

Δ: partially peeled but practically without problem x: 50% or more peeled

We claim:

1. A heat transfer image-receiving sheet comprising: a substrate sheet; and a dye receiving layer formed on a surface of said substrate sheet, said dye receiving layer comprising a graft copolymer including a main chain and at least one releasing segment graft-bonded thereto, said at least one releasing segment comprising at least one segment selected from the group consisting of polysiloxane segments, fluorinated carbon segments, and long chain alkyl segments.

2. A heat transfer image-receiving sheet according to claim 1, wherein the main chain of said graft copolymer is an acrylic, vinyl, polyester, polyurethane, polyamide or cellulose polymer.

3. A heat transfer image-receiving sheet according to claim 1, wherein the content of the releasing segment is 3 to 60% by weight.

TABLE 4

| | Example | | | | | | | | | Comparative Example | | | |
|---|---|---|---|---|---|---|---|---|---|---|---|---|---|
| Evaluation item | C1 | C2 | C3 | C4 | C5 | C6 | C7 | C8 | C9 | C1 | C2 | C3 | C4 |
| Adhesion to substrate | Δ | O | Δ | O | O | O | O | O | O | O | Δ | O | O |
| Releasability | O | Δ | O | Δ | O | O | O | O | O | O | O | O | O |
| Storability of printed dye image | O | O | O | O | O | Δ | O | O | O | X | O | O | Δ |
| Fingerprint resistance | O | O | O | O | O | O | O | O | O | X | O | X | X |
| Plasticizer resistance | O | O | O | O | O | O | O | O | O | X | Δ | X | X |
| Discoloration of substrate | O | O | O | O | O | O | O | O | O | X | O | O | O |
| Printing density | 0.95 | 0.99 | 0.94 | 0.97 | 0.99 | 1.01 | 1.03 | 1.05 | 1.00 | 1.00 | 0.76 | 1.00 | 1.02 |

Releasability: Peelability between the heat transfer sheet and the image-receiving sheet during printing:

O: easily peeled without problem

Δ: slightly adhered but practically without problem

Printing density: measured by Macbeth reflective densitometer (relative optical density when that of Comparative B1 is made 1.00).

4. A heat transfer image-receiving sheet according to claim 1, wherein the dye receiving layer further comprises a dyeable resin and/or a linear polysiloxane release agent.

5. A heat transfer image-receiving sheet according to claim 4, wherein the amount of release agent is 1 to 20 parts by weight per 100 parts by weight of the total resin forming the dye receiving layer.

6. A heat transfer image-receiving sheet according to claim 1, wherein said graft copolymer comprises an acryl urethane silicone resin.

7. A heat transfer image-receiving sheet according to claim 6, wherein the weight ratio of acryl segment:urethane segment:silicone segment of the acryl urethane silicone resin is 10 to 80:10 to 80:10 to 50.

8. A heat transfer image-receiving sheet according to claim 6, wherein the acryl urethane silicone resin is cured by a catalyst.

9. A heat transfer image-receiving sheet according to claim 1, wherein the main chain of said graft copolymer comprises a copolymer of vinyl chloride, a (meth)acrylic acid monomer and a polymer having vinyl group at a terminal end.

10. A heat transfer image-receiving sheet according to claim 9, wherein the copolymerization ratio (weight) of the main chain of said graft copolymer is as shown below:

vinyl chloride/(meth)acrylic acid monomer/polymer having vinyl group = 30–90/5–60/3–20.

11. A heat transfer image-receiving sheet according to claim 1, wherein an adhesion improving layer is provided between the dye receiving layer and the substrate.

12. A heat transfer image-receiving sheet comprising:

a substrate sheet;

a first dye receiving layer formed on a surface of said substrate sheet; and a second dye receiving layer formed on said first dye receiving layer, said second dye receiving layer comprising a graft copolymer including a main chain and at least one releasing segment graft-bonded thereto, said at least one releasing segment comprising at least one segment selected from the group consisting of polysiloxane segments, fluorinated carbon segments and long chain alkyl segments.

* * * * *